US008226108B2

(12) United States Patent
Pontano et al.

(10) Patent No.: US 8,226,108 B2
(45) Date of Patent: Jul. 24, 2012

(54) SNOWBOARD BINDING

(75) Inventors: Peter M. Pontano, Seattle, WA (US); Treu Hahnenberger, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 631 days.

(21) Appl. No.: 12/275,100

(22) Filed: Nov. 20, 2008

(65) Prior Publication Data

US 2009/0134602 A1 May 28, 2009

Related U.S. Application Data

(60) Provisional application No. 60/989,782, filed on Nov. 21, 2007.

(51) Int. Cl.
*A63C 9/14* (2006.01)

(52) U.S. Cl. ..... 280/618; 280/634

(58) Field of Classification Search ..... 280/617, 280/618, 623, 624, 625, 627, 633, 634, 635, 280/636, 14.22, 11.12
See application file for complete search history.

(56) References Cited

U.S. PATENT DOCUMENTS 4,142,734 A * 3/1979 Bentley ..... 280/615
4,157,191 A * 6/1979 Ramer ..... 280/614
4,592,734 A * 6/1986 Metiver ..... 441/74
5,259,128 A * 11/1993 Howell ..... 36/122
5,659,981 A * 8/1997 Liautaud ..... 36/122
5,947,508 A * 9/1999 Graf et al. ..... 280/616
6,527,293 B1 * 3/2003 Roy et al. ..... 280/624
6,726,238 B2 * 4/2004 Poscich ..... 280/624
7,147,233 B2 * 12/2006 Edmond ..... 280/14.22
7,150,464 B2 * 12/2006 Ekberg ..... 280/603
7,159,875 B2 * 1/2007 Seymour ..... 280/14.21
7,493,709 B2 * 2/2009 Trask et al. ..... 36/122
2001/0009320 A1 * 7/2001 Couderc et al. ..... 280/14.24
2005/0161911 A1 * 7/2005 Piva ..... 280/623

* cited by examiner

*Primary Examiner* — Frank Vanaman
(74) *Attorney, Agent, or Firm* — Christensen O'Connor Johnson Kindness PLLC

(57) ABSTRACT

A snowboard binding (100) having a baseplate (110), a highback (118) attached to the baseplate, and a strap assembly (120) including an instep strap subassembly (124) pivotably attached to the baseplate on one side, and releasably attachable to a mounting strap (132) on the other side. The baseplate includes a lateral toe wall (116). The strap assembly includes a forefoot strap (140) having an upper leg (142) that engages the instep strap, optionally a medial leg (144) that attaches to the medial side of the baseplate, and a front leg (146) that engages a front end of the baseplate. The toe portion of the user's boot (90) is engaged by the forefoot strap. The user secures a boot to the binding with a single engagement mechanism, such as a ratchet buckle (130), which secures both the instep portion and the forefoot strap portions of the strap assembly.

22 Claims, 9 Drawing Sheets

SNOWBOARD BINDING

CROSS-REFERENCE TO RELATED APPLICATION

This application claims the benefit of U.S. Provisional Application No. 60/989,782, filed Nov. 21, 2007, the disclosure of which is hereby expressly incorporated by reference in its entirety.

FIELD OF THE INVENTION

The disclosure is in the field of winter sports equipment, and more particularly, in the field of bindings for gliding boards.

BACKGROUND

Strap-type snowboard bindings for releasably securing a rider's boots to the snowboard are known in the art. Strap-type snowboard bindings typically include a baseplate that is adjustably attached to the snowboard and a pivotable highback that allows the rider to rotate the board rearwardly, for example, to force the backside edge of the board into the snow for maneuvering. Typically, an instep strap attaches to one side of the baseplate and releasably engages a mounting strap attached at the opposite side of the baseplate. A tightening mechanism on the instep strap, such as a ratchet-type buckle, engages the mounting strap such that the instep strap can be securely tightened generally over the boot instep area. A separate toe strap is similarly attached to one side of the baseplate and engages a second mounting strap, such that the toe strap can be securely tightened generally over the toe portion of the boot.

However, the conventional toe strap, which extends between the medial and lateral side of the user's forefoot region, has a tendency to crush or force downwardly the ball or forefoot portion of the user's foot, which can cause discomfort to the user and can negatively impact the user's control. The forefoot is composed of the toes, or "phalanges," and their connecting long bones (metatarsals). Each toe comprises several small bones. The big toe has two phalanx bones—distal and proximal, and one joint, called the "interphalangeal joint." The big toe articulates with the head of the first metatarsal, called the "first metatarsophalangeal joint." Underneath the first metatarsal head are two tiny, round bones called "sesamoids." The other toes each comprise three bones and two joints. The phalanges are connected to the metatarsals by five metatarsal phalangeal joints at the ball of the foot. The forefoot generally bears half the body's weight and balances pressure on the ball of the foot.

It will be appreciated that the user's forefoot region is a very complex and shaped anatomical structure. The conventional snowboard binding uses a toe strap that essentially compresses the forefoot portion of the user's foot against the flat snowboard, which is not an ergonomic design. Other binding toe strap designs extend generally over a forward portion of the user's boot, compressing the user's foot in both the vertical direction (against the snowboard) and urging the user's toes rearwardly, which is also not ergonomically helpful.

In addition, in a conventional strap-type snowboard binding system, a rider must engage and tighten four separate mechanisms (two for each foot) every time the rider mounts the snowboard, and must disengage four separate mechanisms every time the rider dismounts from the snowboard. It will be appreciated by riders and other persons of skill in the art that this is particularly burdensome in the icy and mountainous environments for snowboarding. The relatively large number of components required for four separate tightening mechanisms also adds weight and cost to the bindings.

A novel snowboard binding system is disclosed herein that addresses the disadvantages identified above.

SUMMARY

This summary is provided to introduce a selection of concepts in a simplified form that are further described below in the Detailed Description. This summary is not intended to identify key features of the claimed subject matter nor is it intended to be used as an aid in determining the scope of the claimed subject matter.

A snowboard binding is disclosed having a baseplate for receiving a rider's boot and adapted for attachment to a snowboard. The boot is secured to the baseplate with a strap assembly that includes a releasable instep strap subassembly extending from the medial side to the lateral side of the baseplate. The strap assembly also includes a forefoot strap that attaches to the instep strap and extends over the toe of the boot to engage a front of the baseplate.

In an embodiment, the forefoot strap is adjustably attached to the baseplate and/or to the instep strap subassembly such that the effective length of the forefoot strap can be selectively adjusted. In an embodiment, the forefoot strap is formed from an elastic polymer and adapted to urge the rider's boot rearwardly into the binding assembly.

In an embodiment, the forefoot strap engages the front portion of the baseplate within one-half inch of a centerline of the baseplate. In an embodiment, the baseplate is provided with a toe wall on one side of the baseplate and an adjustable mounting bracket opposite the medial toe wall such that the distance between the medial toe wall and the adjustable mounting bracket is adjustable to engage a snowboard boot.

In an embodiment, the forefoot strap further includes a medial leg that extends transversely from the upper leg, and attaches to the medial side of the baseplate. In an embodiment, the medial leg includes a bracket for adjustably attaching the medial leg to the baseplate. In an embodiment, the bracket is a relatively rigid L-shaped member embedded in the medial leg of the forefoot strap. In an embodiment the toe wall height and/or position is adjustable to accommodate different boot toe sizes or configurations.

In an embodiment, the forefoot strap further comprises a webbing portion extending between the front leg and the medial leg of the forefoot strap.

In an embodiment, the binding is configured to receive a boot, and comprises a baseplate sized and configured to be attached to a snowboard, the baseplate having lateral and medial sides, and a front end; and a strap assembly comprising (i) an instep strap subassembly having a medial portion attached to the medial side of the baseplate, a lateral portion attached to the lateral side of the baseplate, and means for releasably attaching the medial portion to the lateral portion; and (ii) a forefoot strap having an upper portion that attaches to the instep strap subassembly, and a front portion that extends over a toe of the boot and engages the front end of the baseplate.

In an embodiment, the binding comprises a baseplate adapted to be attached to a snowboard, the baseplate having lateral and medial sidewalls; a highback pivotably attached to the baseplate; and a strap assembly comprising (i) a first mounting strap pivotably attached to a medial side of the baseplate; (ii) an instep strap adjustably attached to the first mounting strap; (iii) a second mounting strap pivotably attached to the lateral side of the baseplate; (iv) means for releasably attaching the instep strap to the second mounting strap; and (v) a forefoot strap having an upper leg that is attached to the instep strap and a front leg that engages a front portion of the baseplate.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
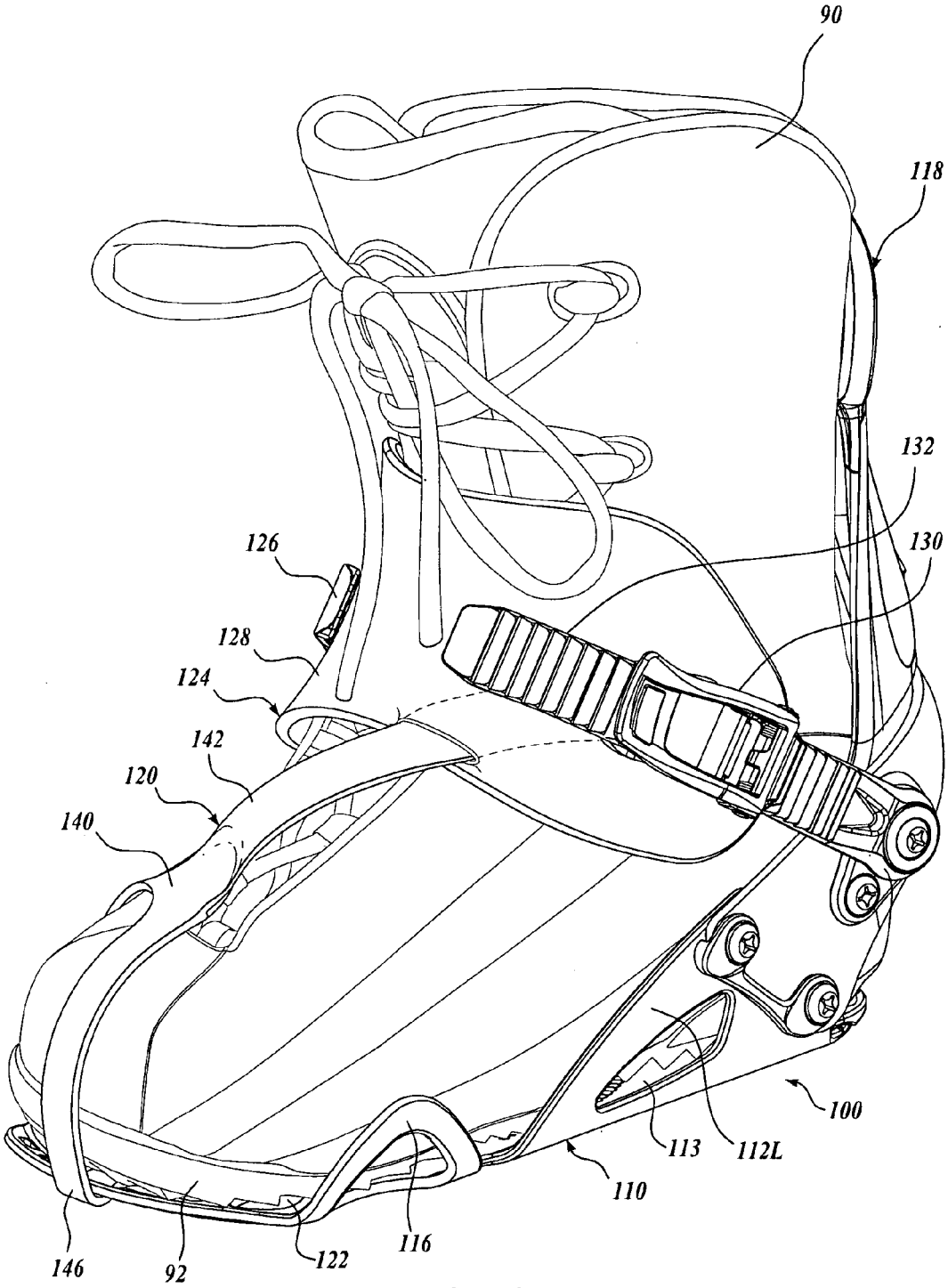
FIG. 1 is a perspective view of a left-foot binding in accordance with the present invention and showing a boot mounted in the binding.
Figure 2:
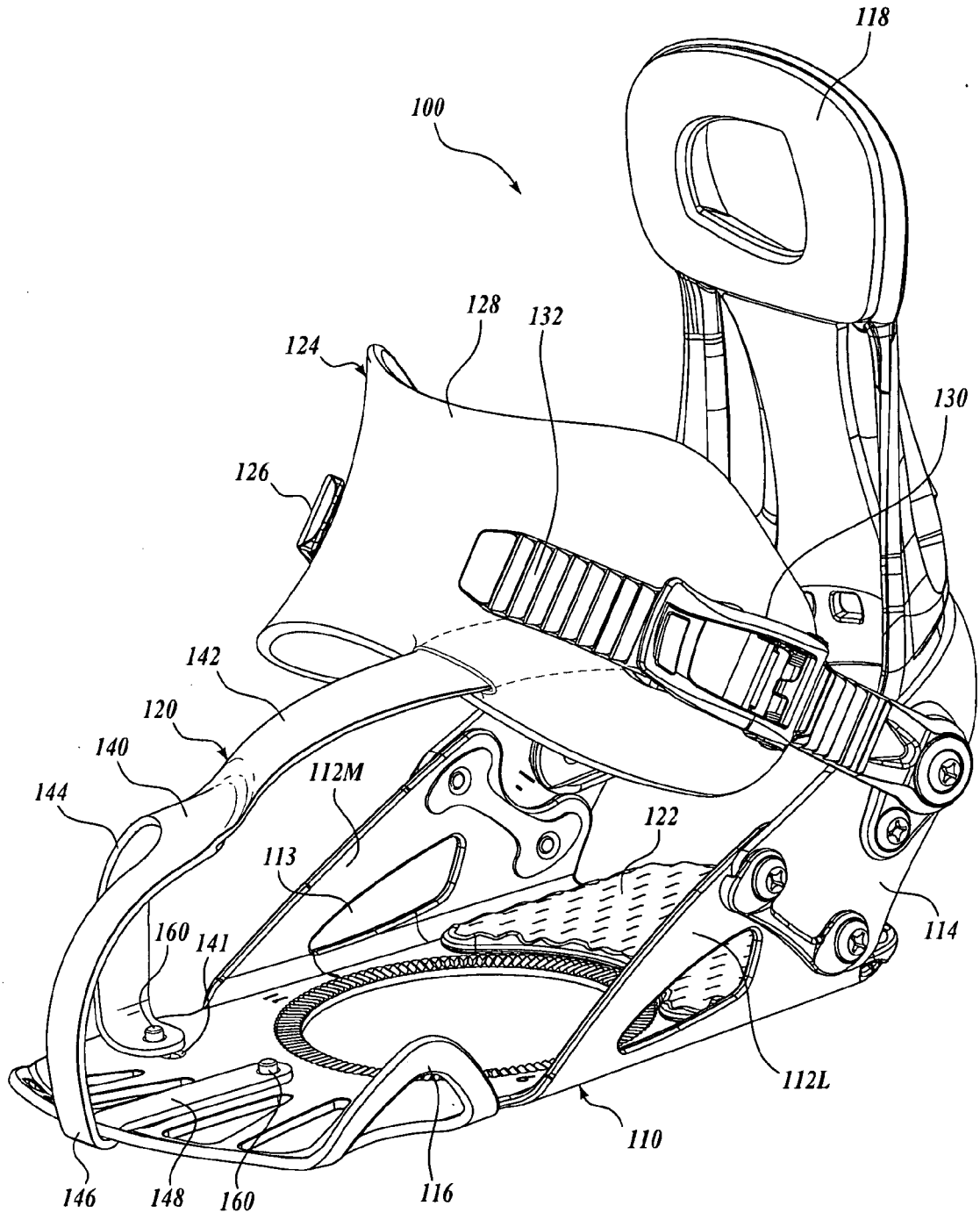
FIG. 2 is a perspective view of the binding of FIG. 1 in isolation and from a front-lateral side.
Figure 3:
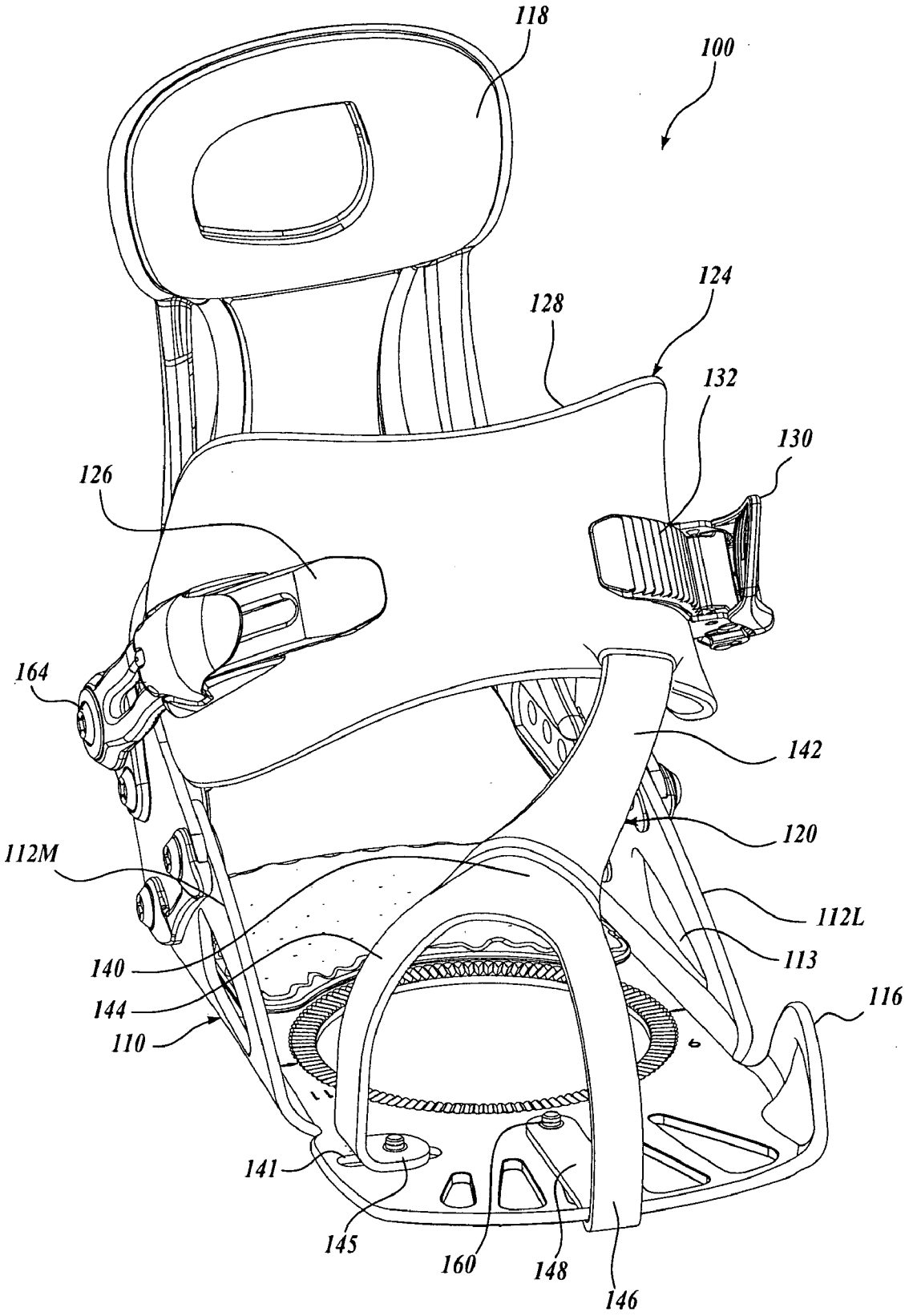
FIG. 3 is a perspective view of the binding of FIG. 1 from a front-medial side.
Figure 4:
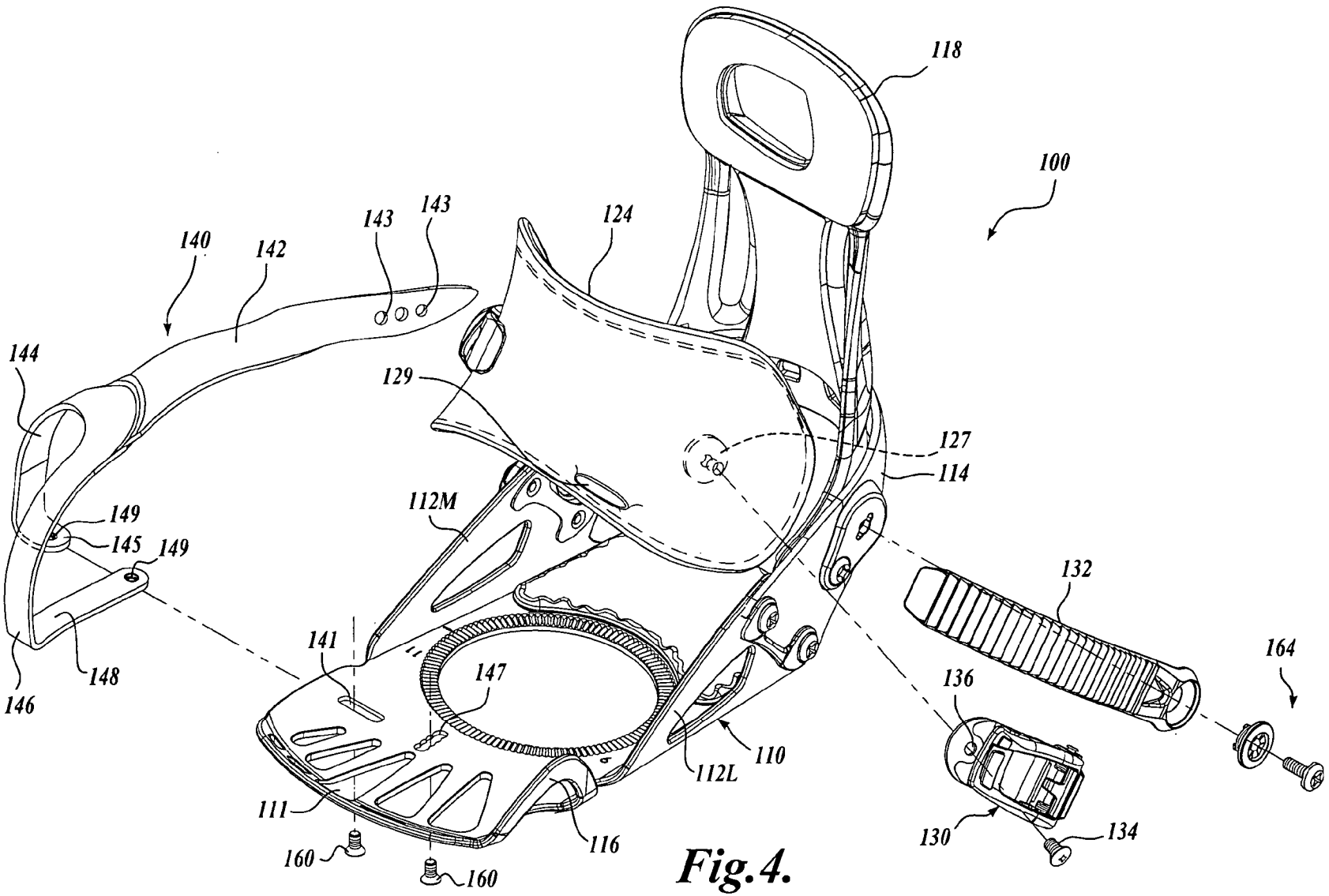
FIG. 4 is a partially exploded perspective view of the binding shown in FIG. 1.

Exemplary embodiments of a snowboard binding in accordance with the teachings of the present invention will be described with reference to the FIGURES, wherein like numbers indicate like parts. FIG. 1 is a perspective view showing the lateral side of a left-foot binding assembly 100 shown with a conventional boot 90 disposed in the binding 100. FIG. 2 is a similar perspective view of the binding assembly 100 in isolation, and FIG. 3 is a perspective view showing the binding assembly 100 generally from the front-medial side. FIG. 4 shows a partially exploded view of the binding assembly 100.

The binding assembly 100 includes a baseplate 110 that is adapted to be adjustably attached to the snowboard (not shown) in any conventional manner. The baseplate 110 includes a medial sidewall 112M, a lateral sidewall 112L, and a heel loop 114 that attaches to both sidewalls 112M, 112L and extends rearwardly around the heel portion of the boot 90. The heel loop 114 is preferably adjustably mounted to the sidewalls 112M, 112L such that the binding assembly 100 will accommodate different boot sizes. In this embodiment, the sidewalls 112L, 112M include lightening apertures 113. A two-piece foam baseplate pad 122 overlies the baseplate 110, for example; the pad 122 may be affixed directly to the baseplate 110 (in FIGS. 2-4 the front portion of the pad 122 is removed for clarity).

A highback 118 is pivotably mounted to the heel loop 114. The highback 118 facilitates the rider's ability to rotate the snowboard rearwardly about its longitudinal axis. The rearward pivot of the highback 118 is limited by the heel loop 114. Typically, a sliding block mechanism 119 (FIG. 6) is provided on the back side of the highback 118, allowing the rider to adjust the maximum forward lean angle, i.e., the angle at which the highback 118 engages the heel loop 114.

A strap assembly 120 is provided for releasably securing the boot 90 in the binding assembly 100. The strap assembly 120 includes an instep strap subassembly 124 comprising a medial mounting strap 126 that pivotably attaches to the medial sidewall 112M, and a padded strap 128 that is adjustably attached to the medial mounting strap 126. The adjustable attachment allows the rider to position the padded strap 128 in a comfortable position over the instep portion of the boot 90. An engagement mechanism 130, such as a ratchet-type buckle, is attached to the lateral side of the padded strap 128. A suitable, exemplary engagement mechanism is disclosed in U.S. Pat. No. 6,748,630, which is hereby incorporated by reference in its entirety. Other engagement mechanisms are also clearly contemplated, as will be readily apparent to persons of skill in the art.

A lateral mounting strap 132, for example, a ladder strap, is pivotably mounted to the lateral sidewall 112L and adapted to engage the engagement mechanism 130 such that the instep strap subassembly 124 can be adjustably secured over the rider's boot 90.

The strap assembly 120 further includes a forefoot strap 140 that engages a forward portion of the boot 90. In this embodiment, an upper leg 142 is adjustably attached to the padded strap 128 and a front leg 146 extends over a front end of the baseplate 110. An optional medial leg 144 extends medially and attaches to the medial side of the baseplate 110. As seen most clearly in FIG. 1, the forefoot strap 140 is positioned such that the medial leg 144 (when present) and front leg 146 extend generally over the front medial portion (e.g., the big toe portion) of the boot 90, to secure the forefoot portion of the boot 90 to the baseplate 110.

In the embodiment shown in FIG. 1, the front leg 146 engages the baseplate 110 near the center of the baseplate, or offset only slightly medially or laterally from the centerline of the baseplate 110, for example, +/−one-half inch. However, alternative configurations are possible and contemplated by the present invention; for example, it is contemplated that two front strap portions (or a bifurcated front strap portion) may extend forwardly from the upper leg 142 to engage the front of the base plate 110 in more than one location.

The forefoot strap 140 is preferably flexible and formed from a stiffly elastic material, such as a polymeric material with a relatively high modulus of elasticity. The elastic forefoot strap 140 elastically engages the front of the boot 90, tending to urge the boot rearwardly, toward the heel loop 114 and into the binding, without producing the downward, crushing-type forces that are produced with conventional toe straps.

In this embodiment, the lateral side of the baseplate 110 includes a rigid upright toe wall 116 that is positioned to engage the lateral side of the boot sole 92. Additional details of the embodiment of FIG. 1 will now be discussed with particular reference to FIG. 4, which is a partially exploded perspective view of the binding assembly 100.

The front leg 146 of the forefoot strap 140 includes an attachment portion 148 that extends through a front slot 111 in the baseplate 110, and is secured to the baseplate 110 with a bolt 160 that extends through a slot 147 in the baseplate 110 and through an aperture or threaded insert 149 imbedded in the attachment portion 148. The effective length of the front leg 146 can be adjusted by selectively positioning the bolt 160 in the slot 147, for example, to accommodate different boot sizes.

The upper leg 142 of the forefoot strap 140 extends into the padded strap 128 through a slot 129. In the disclosed embodiment, the upper leg 142 is formed with an arched or offset base that extends away from the boot 90 such that, for improved comfort, the upper leg 142 does not directly engage the boot 90.

The end portion of the upper leg 142 includes a plurality of apertures 143. An optional nut plate 127 is attached to the padded strap 128 underlying the engagement mechanism 130. A mounting bolt 134 extends through an aperture 136 in the engagement mechanism and selectively through one of the apertures 143 in the upper leg 142, and threadably engages the nut plate 127, thereby adjustably attaching the engagement mechanism 130 and the upper leg 142 to the padded strap 128. It will now be appreciated that the longitudinal position of the forefoot strap 140, and therefore the effective length of the forefoot strap 140, can be adjusted by selectively positioning the bolt 160 in the slot 147 and selecting the aperture 143 to use in the upper leg 142 for engagement with mounting bolt 134.

The medial leg 144 similarly includes an attachment portion 145 having an aperture or a threaded insert 149 therein. A second bolt 160 extends through a transverse slot 141 in the baseplate 110 and engages the threaded insert 149 to adjustably attach the medial leg 144 of the forefoot strap 140 to the medial side of the baseplate 110. In a current embodiment, the threaded insert 149 comprises a relatively rigid L-shaped member embedded in the medial leg 144. The adjustable attachment of the medial leg 144 and the opposing upright wall 116 therefore provide a width-adjustment for securely engaging the sole 92 of the boot 90. The width-adjustable engagement of the sole 92 near the toe of the boot 90 provides additional benefits and control. In particular, the width-adjustable support sole support prevents or reduces the tendency of the boot 90 to slide or pivot about an axis normal to the snowboard, improving a rider's control.

It is contemplated that the upright toe wall 116, shown in FIG. 1 as unitarily formed with the baseplate 110, may alternatively be adjustably mounted on the baseplate 110, such that the distance between the toe wall 116 and the L-shaped insert 149 may be alternatively adjusted from the lateral side. The upright toe wall 116 may also alternatively or additionally be height-adjustable, wherein the user can adjust the vertical extent of the toe wall 116. This would be useful, for example, to accommodate different boots or different snowboarding styles. For example, a particular boot and snowboarding style combination may tend to generate sufficient vertical forces that a taller toe wall 116 is desirable to prevent the boot sole from coming over the toe wall during use. It is further contemplated that the toe wall 116 and/or the upright portion of the L-shaped insert 149 may curve inwardly to more positively engage the sole 92 of the boot.

It is believed to be novel in bindings to include width-adjustable upright supports that extend upwardly from the baseplate to engage a forward portion of the boot. The adjustable upright supports provide benefits in limiting the lateral motion of the boot in the binding. A snowboard binding is contemplated that includes opposed upright toe supports such as toe wall 116 (which may be adjustably attached to the baseplate) and the L-shaped insert 149 or a mounting bracket assembly 150 (as discussed below) independent of the forefoot strap 140 discussed herein.

The lateral mounting strap 132 and medial mounting strap 126 are pivotably attached to opposite sides of the baseplate 110 with mounting hardware 164.

Figure 5:
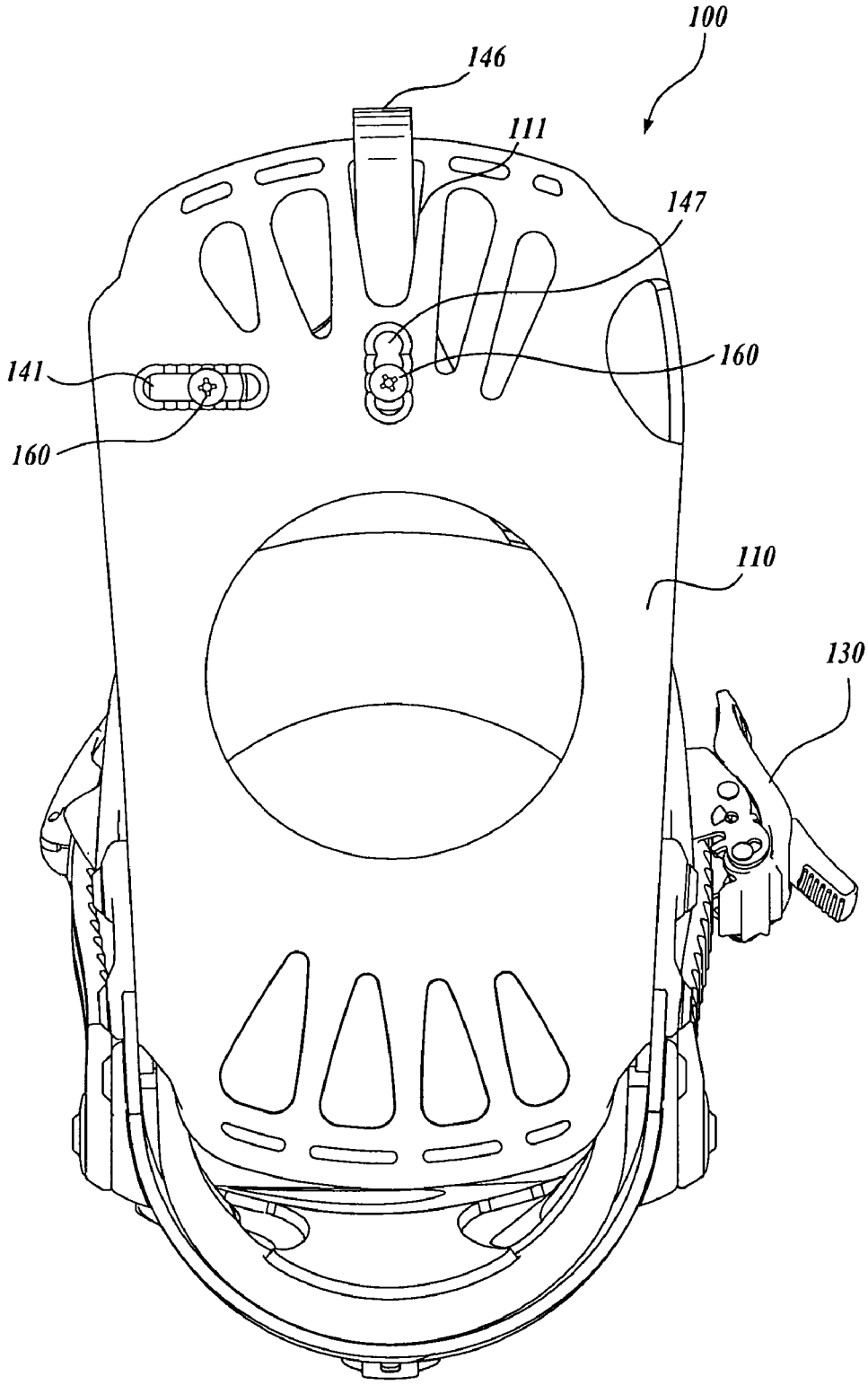
FIG. 5 is a bottom view of the binding assembly shown in FIG. 1.
Figure 6:
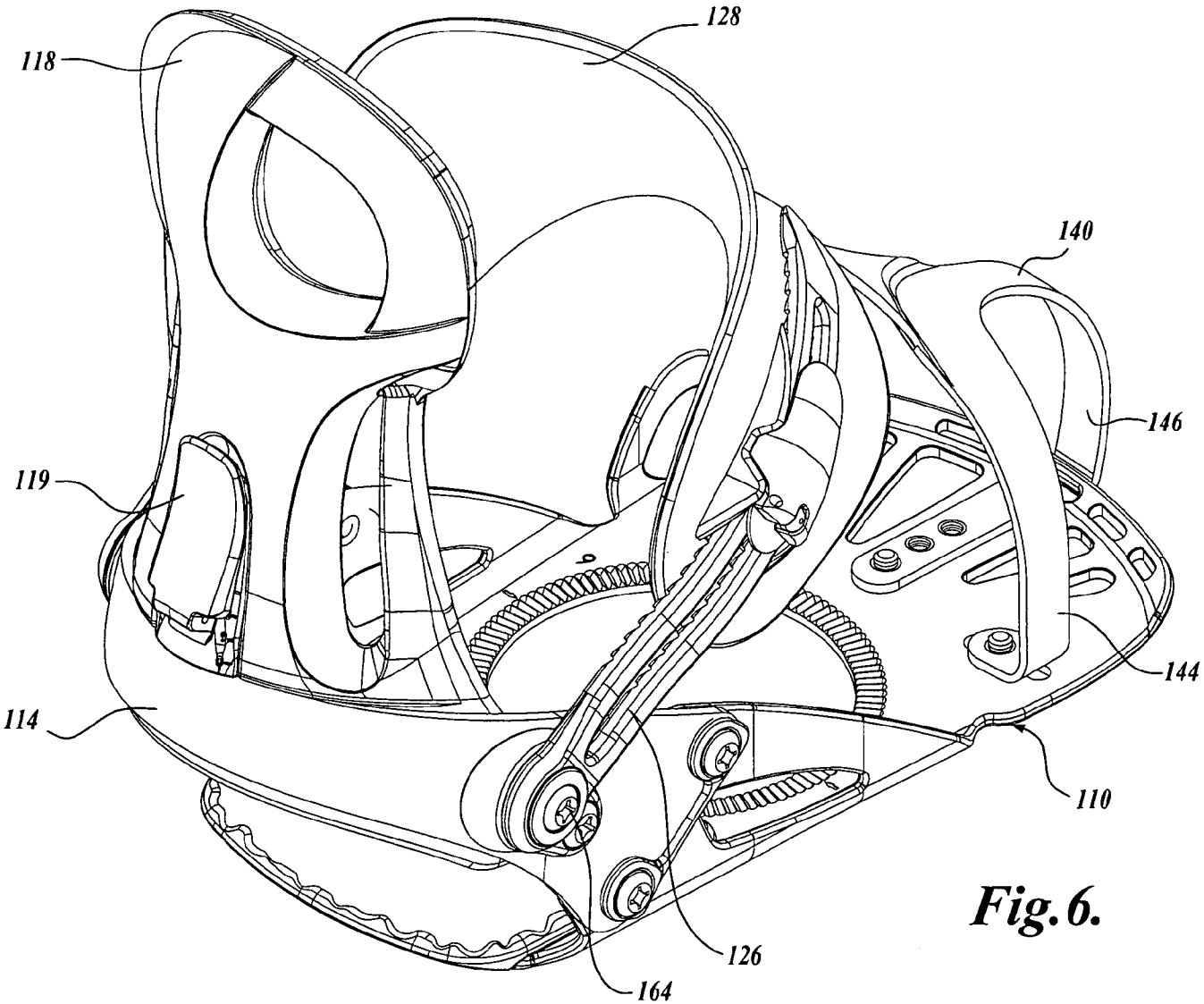
FIG. 6 shows a three-quarter rear perspective view of the binding shown in FIG. 1.

FIG. 5 shows a bottom view of the binding assembly 100, and FIG. 6 shows a rear perspective view of the binding assembly 100, illustrating various other aspects of the current embodiment.

The upright wall 116 and forefoot strap 140 secure the toe portion of the boot 90 (FIG. 1) in the binding assembly 100, and prevent or reduce a tendency of the toe portion of the boot 90 to move laterally in the binding or to lift away, even during high-torque maneuvers. The medial leg 144 and front leg 146 are positioned particularly to limit the movement of the first metatarsal (big toe) in all directions. The binding assembly 100 therefore limits movement of the boot toe-box area in all directions. Moreover, very flexible size adjustment can be accomplished with appropriate selection of the various mounting apertures.

Also, it will also be appreciated that, unlike conventional strap-type bindings, the front leg 144 of the forefoot strap 140 engages the front edge of the baseplate 110. Therefore, when a rider pivots the snowboard rearwardly, the front leg 144 will pull upwardly on the front of the baseplate 110 to provide improved responsiveness during maneuvering.

Another advantage of this embodiment is that the binding assembly 100 allows the rider to engage or disengage each foot from the binding with a single mechanism on the unitary strap assembly 120 rather than having to manipulate instep and toe straps separately. The front leg 146 of the forefoot strap generally urges the boot 90 rearwardly into the binding such that the boot is biased towards the heel pocket of the binding. In particular, the designer and/or user may select the material for the forefoot strap 140 to provide a desired level of elasticity, to suit the user and the type of snowboarding activities.

This strap design of the present invention also places fewer constraints on the baseplate than conventional separate instep and forefoot strap systems, thereby providing the designer with additional freedom to modify the baseplate, for example, to reduce weight/cost, adjust flexure patterns, select different materials, and/or improve binding performance. There are also fewer components, reducing costs and failure modes.

The technology of the present invention enables a snowboard binding to provide foot restraint that urges the user's foot rearwardly into the binding, providing desirable riding response without clamping over the boot downwardly or otherwise producing a crushing force on the forefoot of the user. The disclosed forefoot strap also simplifies the snowboard binding system by providing a single strap assembly that can be attached and tightened onto the foot using a single fastening device. This technology provides substantially faster (~50%) entry and exit from the snowboard binding. This advantage is accomplished using a forefoot strap that engages the front portion of the binding baseplate and connects to the instep strap, improving the boot securement by pushing the boot back into the heel-pocket of the binding. The configuration provides a unique mounting configuration in medial ankle strap mount, front/medial forefoot strap mount, and lateral ankle/toe mount through a single fastening device and mounting strap.

Figure 7:
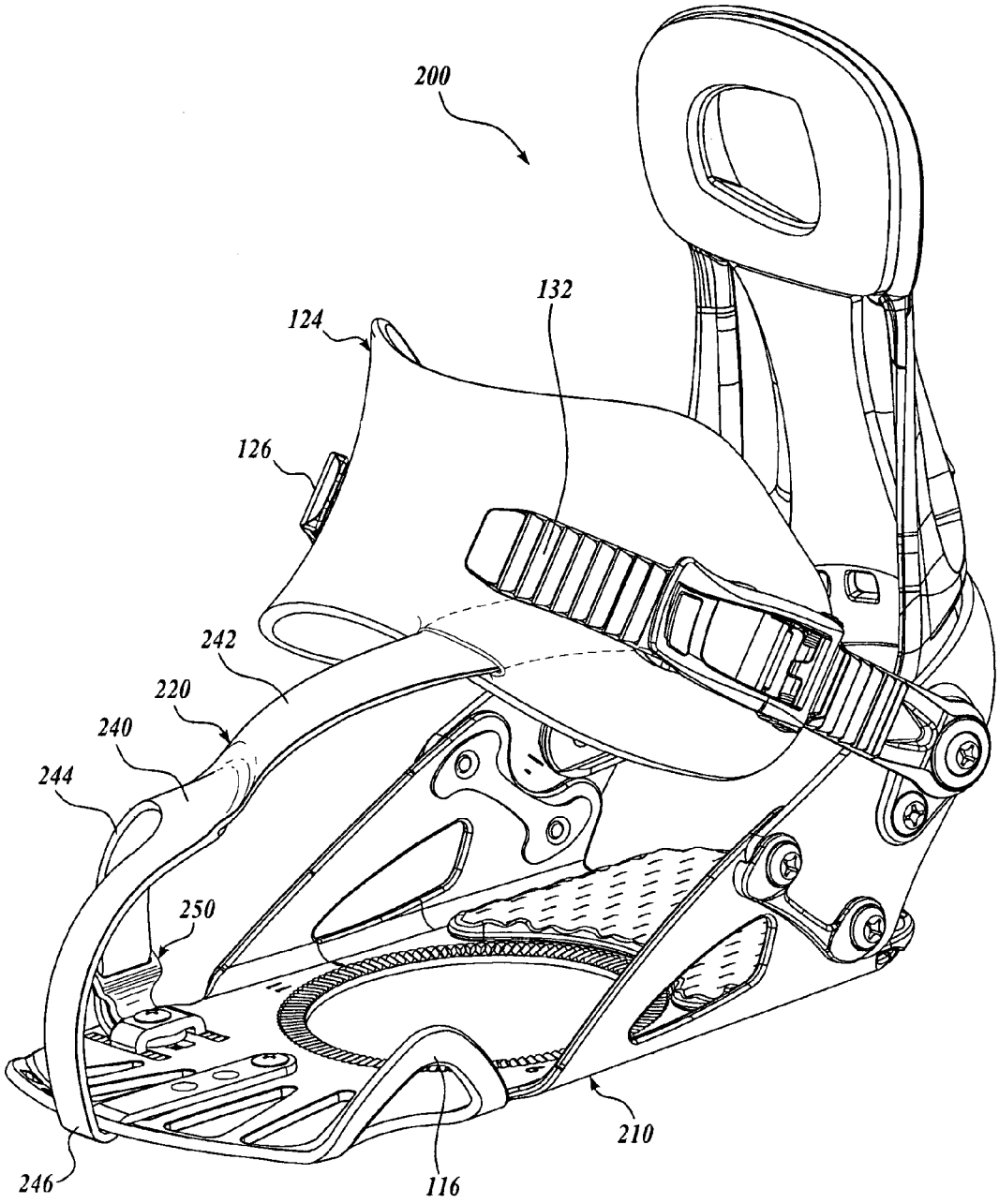
FIG. 7 shows a perspective view of a second embodiment of a binding in accordance with the present invention.
Figure 8:
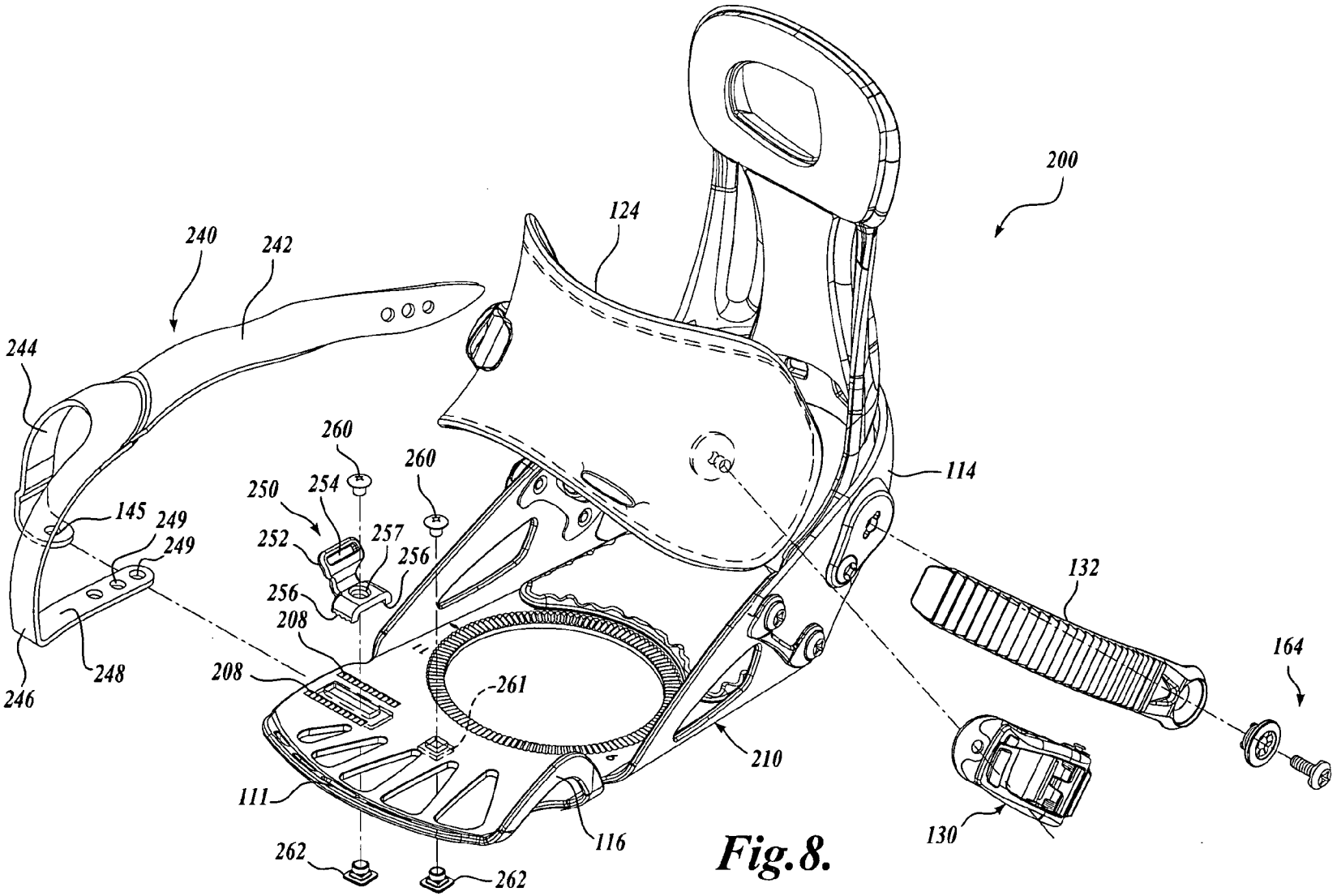
FIG. 8 shows a partially exploded view of the binding shown in FIG. 7.

An alternative embodiment of a binding assembly 200 in accordance with the present invention is shown in FIG. 7, and an exploded view is shown in FIG. 8. Many aspects of this embodiment are similar to the binding assembly 100, and common aspects will not be repeated here, for brevity. In this embodiment, the forefoot strap 240 includes an upper leg 242 that is essentially the same as the upper leg 142 discussed above. The front leg 246 includes an attachment portion 248 having a plurality of apertures 249 that may be selectively attached to the baseplate 210 with a bolt 260 and nut plate 262 disposed in a shaped recess 261.

The medial leg 244 attachment portion 245 is adjustably attached to the baseplate 210 with an adjustable rigid mounting bracket 250 mounted to the baseplate 210 generally opposite the upright toe wall 116. The mounting bracket 250 includes an upright portion 252 that can be positioned to engage the boot sole 92 (FIG. 1) opposite the upright toe wall 116. It will be appreciated that the mounting bracket 250 in this embodiment functions as an adjustable toe wall opposite the toe wall 116. Moreover, the toe wall 116 could alternatively be constructed for adjustment on the baseplate 210. As discussed above the toe wall may also be height-adjustable without departing from the present invention.

The upright portion 252 of the adjustable mounting bracket 250 includes a slot 254 that is sized and positioned to slidably receive the medial leg 244 of the forefoot strap 240. An aperture is provided in the attachment portion 245 of the medial leg 244, which extends through the slot 254 and under the mounting bracket 250, between the baseplate 210 and the mounting bracket 250. Oppositely disposed toothed feet 256 of the mounting bracket 250 selectively engage toothed tracks 208 on the baseplate 210. A bolt 260 and nut plate 262 extend through the baseplate 210, through the medial leg aperture, and through aperture 257 in the mounting bracket 250 to adjustably attach the mounting bracket 250 and medial leg 244 to the baseplate 210.

Figure 9:
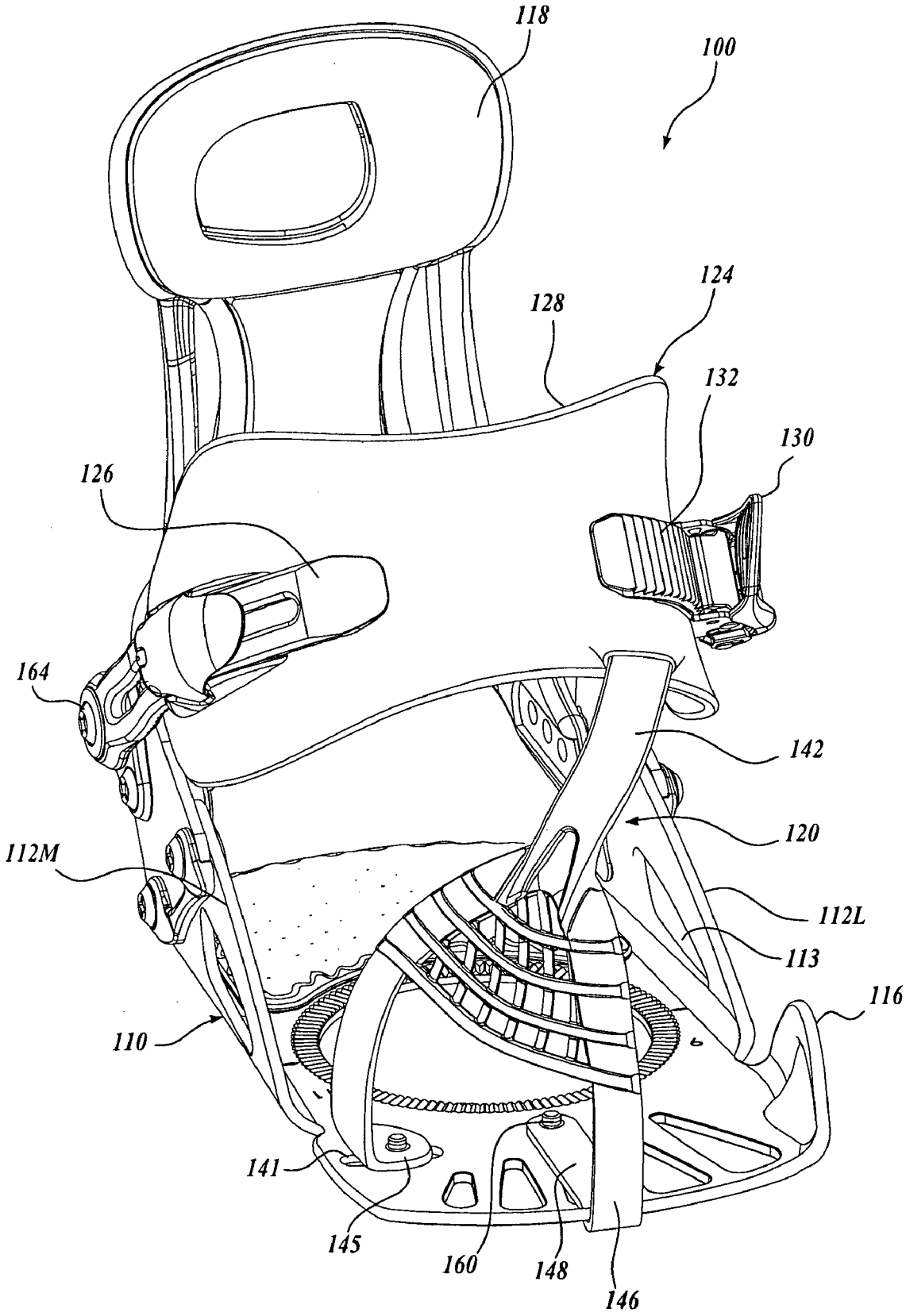
FIG. 9 shows a perspective view of a third embodiment of a binding in accordance with the present invention.

Another alternative embodiment of a binding assembly 300 in accordance with the present invention is shown in FIG. 9. Many aspects of this embodiment are similar to the binding assembly 100, and common aspects will not be repeated here, for brevity. In this embodiment, the forefoot strap 340 includes an upper leg 342 that is essentially the same as the upper leg 142 discussed above. The front leg 346 and the medial leg 344 further comprise a webbing portion 350 disposed therebetween for at least a portion of the length of the legs 346, 344. The webbing portion 350 engages a toe portion of the boot 90 (FIG. 1), providing additional elastic support for urging the boot 90 rearwardly into the binding and spreading the loads on the boot 90 over a larger area. The webbing portion 350 also helps to maintain a desired spacing between the legs of the forefoot strap 340.

The webbing portion 350 may be co-molded with the forefoot strap 340, or may be affixed to the strap 340. Although the webbing portion 350 shown in FIG. 9 comprises a plurality of intersecting strands, it will be appreciated that the webbing portion 350 may alternatively comprise only horizontal strands, or may comprise a planar panel, for example.

While preferred embodiments of the invention has been illustrated and described, it will be appreciated that various changes can be made therein without departing from the spirit and scope of the invention. For example, the forefoot strap and instep strap portions may be formed as a unitary strap, or the forefoot strap may engage the instep strap at more than one location, e.g., having more than one upper leg portion. Similarly, the forefoot strap may include more than one medial and/or front leg portion. It is also contemplated that the forefoot strap may engage the baseplate at locations other than those shown in the current embodiment.

In yet another contemplated embodiment, the upper leg may adjustably engage the padded strap through a separate buckle such that the user can adjust the forefoot strap without dismounting from the binding. Also, the lateral upright toe wall 116 may be adjustable, similar to the mounting bracket 250. These and other alternatives will be readily apparent to persons of skill in the art.

While illustrative embodiments have been illustrated and described, it will be appreciated that various changes can be made therein without departing from the spirit and scope of the invention.

The embodiments of the invention in which an exclusive property or privilege is claimed are defined as follows:

1. A snowboard binding comprising:

a baseplate having a medial side, a lateral side, and a front end extending between the medial side and the lateral side; and a strap assembly including an instep strap releasably extending from the medial side of the baseplate to the lateral side of the baseplate, and a forefoot strap having an upper leg that engages the instep strap, a medial lea that attaches to the medial side of the baseplate, and a front leg that engages the front end of the baseplate between the medial side and the lateral side of the baseplate such that the forefoot strap is configured to extend from an instep portion of a user's boot and over a toe end of a user's boot during use;

wherein the medial leg of the forefoot strap comprises a bracket for attaching the medial leg to the baseplate, and further wherein the baseplate comprises an upright toe wall disposed opposite the bracket of the medial leg of the forefoot strap.

2. The snowboard binding of claim 1, wherein the front leg of the forefoot strap is adjustably attached to the baseplate such that the effective length of the forefoot strap is selectively adjustable.

3. The snowboard binding of claim 1, wherein the upper leg of the forefoot strap is adjustably attached to the instep strap such that the effective length of the forefoot strap is selectively adjustable.

4. The snowboard binding of claim 1, wherein the forefoot strap is formed from an elastic polymer.

5. The snowboard binding of claim 1, wherein the forefoot strap engages the front end of the baseplate within one-half inch of a centerline of the baseplate.

6. The snowboard binding of claim 1, wherein the bracket opposite the toe wall is adjustably attached to the baseplate such that the distance between the toe wall and the adjustable mounting bracket is adjustable to engage a snowboard boot.

7. The snowboard binding of claim 1, wherein the bracket comprises an L-shaped member embedded in the medial leg of the forefoot strap.

8. The snowboard binding of claim 1, wherein the forefoot strap secures a toe portion of the user's boot to the binding without producing a crushing force on a forefoot portion of the user's boot.

9. The snowboard binding of claim 1, wherein the forefoot strap further comprises a webbing portion extending between the front leg and the medial leg of the forefoot strap.

10. A snowboard binding configured to receive a boot, the snowboard binding assembly comprising:

a baseplate sized and configured to be attached to a snowboard, the baseplate having lateral and medial sides, and a front end extending between the lateral and medial sides; and a strap assembly comprising (i) an instep strap subassembly having a medial portion attached to the medial side of the baseplate, a lateral portion attached to the lateral side of the baseplate, and means for releasably attaching the medial portion to the lateral portion; and (ii) a forefoot strap having an upper portion that engages the instep strap subassembly, and a front portion that extends over a toe of the boot and engages the front end of the baseplate between the lateral and medial sides of the baseplate;

wherein the forefoot strap further comprises a transverse portion that extends transversely from the upper portion, and adjustably attaches to one of the medial side of the baseplate and the lateral side of the baseplate with a mounting bracket, and wherein the baseplate further comprises a toe wall extending upwardly from the baseplate and disposed opposite the mounting bracket.

11. The snowboard binding of claim 10, further comprising means for pivotably attaching the instep strap subassembly to the baseplate.

12. The snowboard binding of claim 10, wherein the forefoot strap is adjustably attached to the baseplate.

13. The snowboard binding of claim 10, wherein the forefoot strap comprises an elastic, polymeric material.

14. The snowboard binding of claim 10, wherein the front portion of the forefoot strap engages the baseplate near a centerline of the baseplate.

15. The snowboard binding of claim 10, wherein the mounting bracket comprises an L-shaped member embedded in the transverse portion of the forefoot strap.

16. The snowboard binding of claim 10, wherein the forefoot strap further comprises an elastic webbing portion extending between the front portion and the transverse portion of the forefoot strap.

17. The snowboard binding of claim 16, wherein the webbing portion is co-molded with the forefoot strap front portion and transverse portion.

18. A snowboard binding comprising:

a baseplate adapted to be attached to a snowboard, the baseplate having a lateral side and a medial side;

a highback pivotably attached to the baseplate; and a strap assembly comprising (i) a first mounting strap pivotably attached to a medial side of the baseplate; (ii) an instep strap adjustably attached to the first mounting strap; (iii) a second mounting strap pivotably attached to the lateral side of the baseplate; (iv) means for releasably attaching the instep strap to the second mounting strap; and (v) a forefoot strap having an upper leg that engages the instep strap and a front leg that engages a front end of the baseplate between the lateral side and the medial side of the baseplate;

wherein the baseplate further comprises an upright toe wall and further wherein the forefoot strap further comprises a medial leg that attaches to the baseplate with a mounting bracket adjustably attached to the baseplate, the mounting bracket being disposed opposite the upright toe wall.

19. The snowboard binding of claim 18, wherein the forefoot strap is formed unitarily from a polymeric material.

20. The snowboard binding of claim 18, wherein the upper leg of the forefoot strap adjustably engages the instep strap such that the effective length of the forefoot strap is adjustable.

21. The snowboard binding of claim 18, wherein the front leg of the forefoot strap adjustably engages the baseplate such that the effective length if the forefoot strap is adjustable.

22. The snowboard binding of claim 18, wherein the front leg of the forefoot strap engages the front end of the baseplate medially from a centerline of the baseplate.

* * * * *

UNITED STATES PATENT AND TRADEMARK OFFICE

CERTIFICATE OF CORRECTION

PATENT NO. : 8,226,108 B2
APPLICATION NO. : 12/275100
DATED : July 24, 2012
INVENTOR(S) : Peter M. Pontano et al.

It is certified that error appears in the above-identified patent and that said Letters Patent is hereby corrected as shown below:

In the Claims

| COLUMN | LINE | ERROR |
|---|---|---|
| 8 (Claim 1, line 8) | 14 | "medial lea" should read --medial leg-- |
| 10 (Claim 21, line 3) | 26 | "length if the" should read --length of the-- |

Signed and Sealed this
Sixth Day of August, 2013

Teresa Stanek Rea
*Acting Director of the United States Patent and Trademark Office*